United States Patent [19]

McKay et al.

[11] Patent Number: 4,844,125

[45] Date of Patent: Jul. 4, 1989

[54] ELECTRICALLY-OPERABLE FLUID CONTROL VALVE

[75] Inventors: Richard J. McKay; Philip Hudson, both of Wolverhampton, England

[73] Assignee: Lucas Industries Public Limited Company, Birmingham, England

[21] Appl. No.: 199,986

[22] Filed: May 27, 1988

[30] Foreign Application Priority Data

Jun. 6, 1987 [GB] United Kingdom ..... 8713304

[51] Int. Cl.[4] ..... F15B 13/044

[52] U.S. Cl. ..... 137/625.65; 137/625.63; 137/625.64

[58] Field of Search ..... 137/596, 625.63, 625.64, 137/625.65

[56] References Cited

U.S. PATENT DOCUMENTS

| | | | |
|---|---|---|---|
| 1,125,825 | 1/1915 | Englesson | 137/625.63 |
| 2,981,288 | 4/1961 | Strader | 137/625.6 |
| 3,253,613 | 5/1966 | Richolt | 137/596 |
| 3,768,376 | 10/1973 | Orme | 137/596 X |
| 3,865,140 | 2/1975 | Greenwood | 137/625.65 X |
| 4,526,201 | 7/1985 | Geyler et al. | 137/625.63 |

*Primary Examiner*—Gerald A. Michalsky

*Attorney, Agent, or Firm*—Michael F. Petock

[57] ABSTRACT

A first control element is movable to control fluid flow between ports in a housing. A second control element is movable by an electric force motor and engages the first element through biasing springs so that in normal use the elements move in unison. An arrangement of ports and passages in the elements has the effect that relative movement between the elements as a result of jamming of the first element causes fluid pressure to be applied to the first element to overcome the jamming.

9 Claims, 1 Drawing Sheet

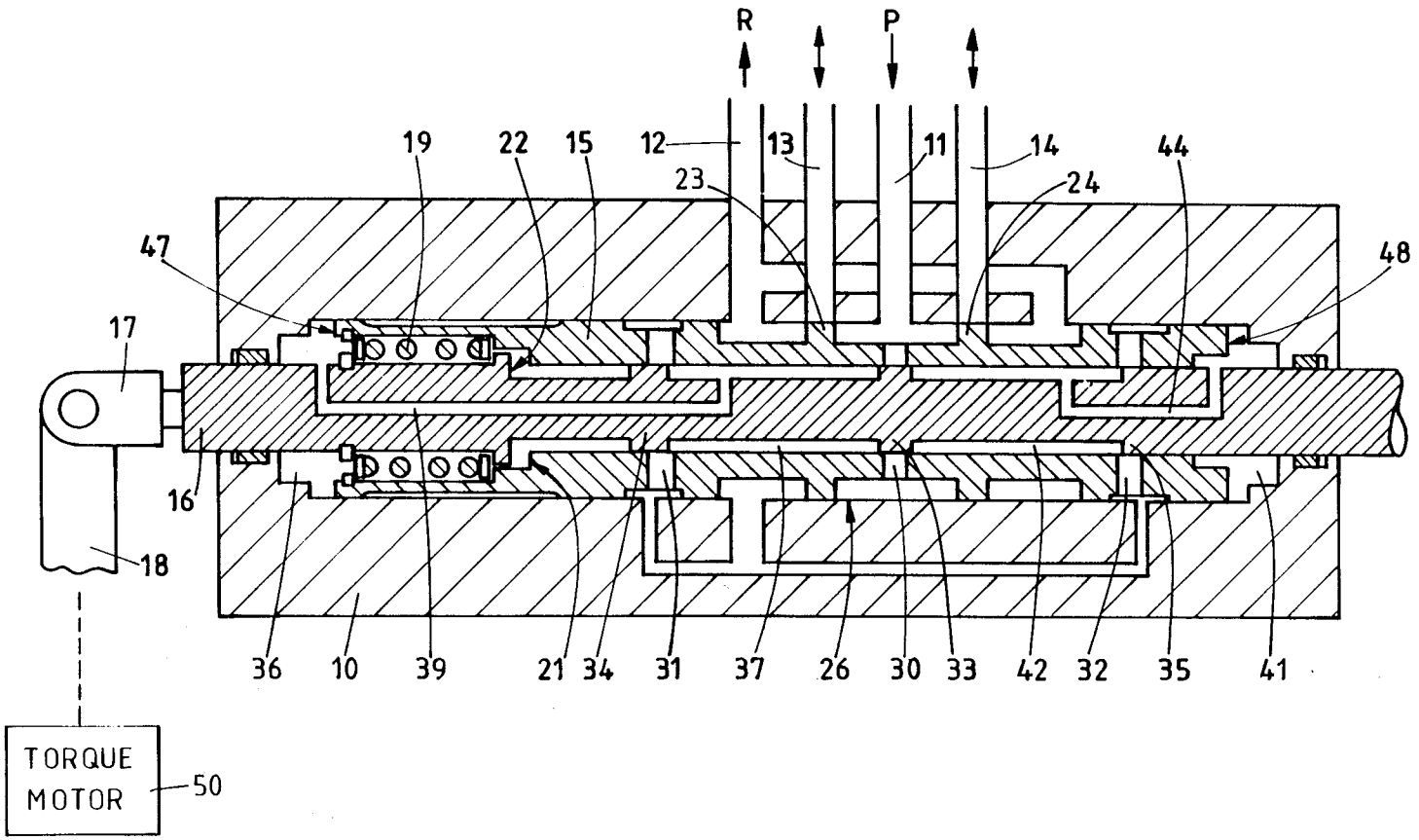
48
44
14
24
11
P
13
R
12
23
15
22
19
47
17
16
18
41
35
32
42
33
30
26
37
31
34
21
39
10
36
50
TORQUE MOTOR

ELECTRICALLY-OPERABLE FLUID CONTROL VALVE

It has been proposed to use an electric force motor directly to position a valve flow control element. For normal operation of the valve a force motor output of 250 N is generally adequate. In such an arrangement it has previously been considered necessary that the motor shall be sufficiently large as to overcome any jamming of the control element, typically by metal particles which may lodge between the lands of the element and the ports of a co-operating sleeve. Unsticking of a jammed control element is normally effected by shearing the chip causing the jamming. The force required to unstick a jammed control element is typically 1 kiloNewton, which would require a very large motor.

It is an object of the invention to provide a fluid control valve which is directly driven by an electric force motor which is not larger than force motors required for normal operation, and in which jamming of the valve will nevertheless be overcome.

According to the invention a fluid control valve comprises a ported housing, a first control element movable in said housing by an electric force motor to control flow between the ports in said housing, the valve including a second control element slidably engaging said first control element, said second element being provided with means for engagement by said force motor, a biasing spring between said first and second elements for urging said first element to move with said second element and to permit movement by said motor of said second element in either direction relative to said first element, said first and second elements being provided with co-operating passages so that, as a result of said relative movement a supply pressure is applied to respective ends of said first element to urge the latter to follow said second element.

An embodiment of the invention will now be described by way of example only and with reference to the accompanying drawing which is a diagrammatic section through a spool control valve for fluid.

A housing 10 has ports 11, 12 for a supply pressure P and return pressure R respectively, as well as ports 13, 14 for controlled pressures to an external apparatus (not shown). Slidable within a bore 26 of the housing 10 is a first spool control element 15 having lands 23, 24 which allow ports 11, 12 selectively to communicate with ports 13, 14.

Slidable within the spool control element 15 is a second spool control element 16 provided at one end with means 17 for pivotal attachment to an arm 18 of a torque motor 50, which may be an electric force motor. A biasing spring 19 is interengaged between the elements 15 and 16 so that the element 15 is urged to follow movement of the element 16 in both directions. The pre-loading of the spring 19 is such that if the element 15 sticks or jams in the housing 10, the element 16 can be moved a limited distance relative to the element 15 by the torque motor 50. This relative movement is limited by abutments 21, 22 on the elements 15, 16 respectively.

The control element 15 has ports 30 which are in constant communication with the port 11 and ports 31, 32 which are in constant communication with the port 12. The ports 31, 32 communicate with the port 12 by way of a zone of the bore 26 which is diametrally opposite the port 12, whereby pressure fluctuations resulting from turbulence adjacent the port 12 are reduced.

Lands 33, 34, 35 on the element 16 control flow through the port 30, 31, 32 respectively. In a rightward relative position (as viewed in the drawing) of the element 15 with respect to the element 16 the port 11 communicates with a chamber 36 at one end of the element 15 by way of the port 30, an annular passage 37 and an axial passage 39. In this relative position the port 12 communicates with a chamber 41 at the other end of the element 15 by way of the port 32, an annular passage 42 and an axial passage 44. The supply pressure P applied to a face 47 of the element 15 and the return pressure 5 applied to an opposing face 48 thus urge the element 15 to follow the element 16, independently of force applied to the element 16.

It will be apparent that relative movement in the opposite direction between the elements 15, 16 will also cause the element 15 to follow the element 16.

In general, chips which may cause jamming of a valve spool originate in parts of a hydraulic system outside the valve. The ports 30, 31, 32 may be much smaller than the ports 11–14, since the former have only to accommodate small servo flows within the valve. The probability of chips passing through ports 30, 31, 32 to jam the element 16 is therefore much reduced, and those chips which may so pass are sufficiently small as to be sheared or deformed by the force available from the motor.

It is to be understood that in alternative embodiments of the invention the first and second control elements may not be axially movable spool, but be angularly movable relative to the housing and to each other.

What is claimed:

1. A fluid control valve comprising a housing having a first and second ports for connection respectively to a supply pressure and to a lower pressure, a first control element movable in said housing for regulating fluid flow, a second control element slidably engaging said first control element, an electric force motor for moving said second control element relative to said housing, and a biassing spring engaged between said first and second elements for resiliently permitting relative movement therebetween, said spring being pre-loaded so that the force required to move said first control element is less than the force required to strain said spring, said second control element having first and second passages which open on to respective ends of said first element, and said second element having porting control means for selectively connecting said first and second ports in the housing to said first and second passages respectively, or to said second and first passages respectively in response to relative movement between said elements in respective opposite directions.

2. A valve as claimed in claim 1 which includes a first port in said first element in constant communication with said supply pressure, a land on said second element co-operating with said first port in said first element for selectively connecting said passages in said second element with said supply pressure in response to respective opposite directions of relative movement between said elements.

3. A valve as claimed in claim 2 which includes second ports in said first element in constant communication with a lower pressure, and lands on said second element co-operating with respective ones of the second ports in said first element for selectively connecting said lower pressure to the passages in said second element.

4. A valve as claimed in claim 1 in which said element are axially slidable spools.

5. A valve as claimed in claim 4 in which said second element is axially slidable within said first element.

6. A valve as claimed in claim 5 in which the passages in said second element axially therein.

7. A valve as claimed in claim 1 in which said housing has third and fourth ports, said first control element being operable to connect said first and second ports selectively to said third and fourth ports respectively or to said fourth and third ports respectively.

8. A valve as claimed in claim 7 which includes a first port in said first element in constant communication with said supply pressure, a land on said second element cooperating with said first port in said first element for selectively connecting said passages in said second element with said supply pressure in response to respective opposite directions of relative movement between said elements.

9. A valve as claimed in claim 8 which includes second ports in said first element in constant communication with a lower pressure, and lands on said second element co-operating with respective ones of said second ports in said first element for selectively connecting said lower pressure to the passages in said second element.

* * * * *

UNITED STATES PATENT AND TRADEMARK OFFICE

CERTIFICATE OF CORRECTION

PATENT NO. :4,844,125

DATED :July 4, 1989

INVENTOR(S) :Richard J. McKay and Philip Hudson

It is certified that error appears in the above-identified patent and that said Letters Patent is hereby corrected as shown below:

Column 2, line 2, delete "port" and substitute --ports--.

Column 2, line 11, delete "5" and substitute--R--.

Column 2, line 30, delete "spool" and substitute --spools--.

Claim 4, line 1, delete "element" and substitute --elements--.

Claim 6, line 2, after "element", insert --extend--.

Signed and Sealed this

Twenty-fourth Day of April, 1990

*Attest:*

HARRY F. MANBECK, JR.

*Attesting Officer*

*Commissioner of Patents and Trademarks*